US008686903B2

(12) United States Patent
Chou

(10) Patent No.: US 8,686,903 B2
(45) Date of Patent: Apr. 1, 2014

(54) ANTENNA

(75) Inventor: Chen-Yu Chou, New Taipei (TW)

(73) Assignee: Wistron Corp., New Taipei (TW)

( * ) Notice: Subject to any disclaimer, the term of this patent is extended or adjusted under 35 U.S.C. 154(b) by 317 days.

(21) Appl. No.: 13/073,444

(22) Filed: Mar. 28, 2011

(65) Prior Publication Data

US 2012/0098707 A1 Apr. 26, 2012

(30) Foreign Application Priority Data

Oct. 20, 2010 (TW) ..... 99135708 A

(51) Int. Cl.
*H01Q 1/36* (2006.01)

(52) U.S. Cl.
USPC ..... 343/700 MS

(58) Field of Classification Search
USPC ..... 343/700 MS
See application file for complete search history.

(56) References Cited

U.S. PATENT DOCUMENTS 7,215,287 B2 5/2007 Quintero Illera et al.
7,501,987 B2 * 3/2009 Wang et al. ..... 343/702
7,760,143 B2 * 7/2010 Wei ..... 343/700 MS
7,868,831 B2 * 1/2011 Hung et al. ..... 343/700 MS
8,072,389 B2 * 12/2011 Chang et al. ..... 343/846
2007/0030198 A1 * 2/2007 Wei ..... 343/700 MS

FOREIGN PATENT DOCUMENTS

CN 101335375 A 12/2008

OTHER PUBLICATIONS

China Patent Office, Office Action, Patent Application Serial No. 201010517852.X, Jun. 5, 2013, China.

* cited by examiner

*Primary Examiner* — Seung Lee

(57) ABSTRACT

An antenna is provided. The antenna includes a ground element, a connection element, a first radiator and a second radiator. The connection element is connected to the ground element. The first radiator is connected to the connection element and extends toward a first direction, wherein the first radiator transmits a first wireless signal. The second radiator is connected to the connection element and extends toward the first direction, wherein the second radiator is parallel to the first radiator, the second radiator transmits a second wireless signal, and a frequency of the first wireless signal is different from a frequency of the second wireless signal, and when the antenna transmits the first and second wireless signals, the first radiator resonates with the second radiator.

12 Claims, 4 Drawing Sheets

ANTENNA

CROSS REFERENCE TO RELATED APPLICATIONS

This Application claims priority of Taiwan Patent Application No. 099135708, filed on Oct. 20, 2010, the entirety of which is incorporated by reference herein.

BACKGROUND OF THE INVENTION

1. Field of the Invention

The present invention relates to an antenna, and in particular relates to an antenna with increased bandwidth.

2. Description of the Related Art

Conventionally, to increase bandwidth of an antenna, width of a radiator of the antenna must be increased, or an extension portion and bending portion are required to be formed on the radiator of the antenna. The dimension of the conventional antenna is therefore increased due to its structure.

Nowadays, a single antenna must satisfy many transmission standards (for example, WLAN, WIFI, Bluetooth and WIMAX) simultaneously. However, the antenna which satisfies these transmission standards has a complex structure and large dimensions, and interference may be generated between radiators of different bands of the antenna.

BRIEF SUMMARY OF THE INVENTION

An antenna is provided. The antenna includes a ground element, a connection element, a first radiator, a second radiator, a third radiator and a fourth radiator. The connection element is connected to the ground element. The first radiator is connected to the connection element and extends toward a first direction, wherein the first radiator transmits a first wireless signal. The second radiator is connected to the connection element and extends toward the first direction, wherein the second radiator is parallel to the first radiator, the second radiator transmits a second wireless signal, a frequency of the first wireless signal is different from a frequency of the second wireless signal, and when the antenna transmits the first and second wireless signals, the first radiator resonates with the second radiator. The third radiator is connected to the connection element and extends toward a second direction, wherein the third radiator transmits a third wireless signal. The fourth radiator is connected to the connection element and extends toward the second direction, wherein the fourth radiator is parallel to the third radiator, the fourth radiator transmits a fourth wireless signal, a frequency of the third wireless signal is different from a frequency of the fourth wireless signal, and the first direction is opposite to the second direction, and when the antenna transmits the third and fourth wireless signals, the third radiator resonates with the fourth radiator.

In the embodiment of the invention, the first radiator resonates with the second radiator to increase bands of the first and second wireless signals, and the third radiator resonates with the fourth radiator to increase bands of the third and fourth wireless, thus, satisfying wideband transmission requirements.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
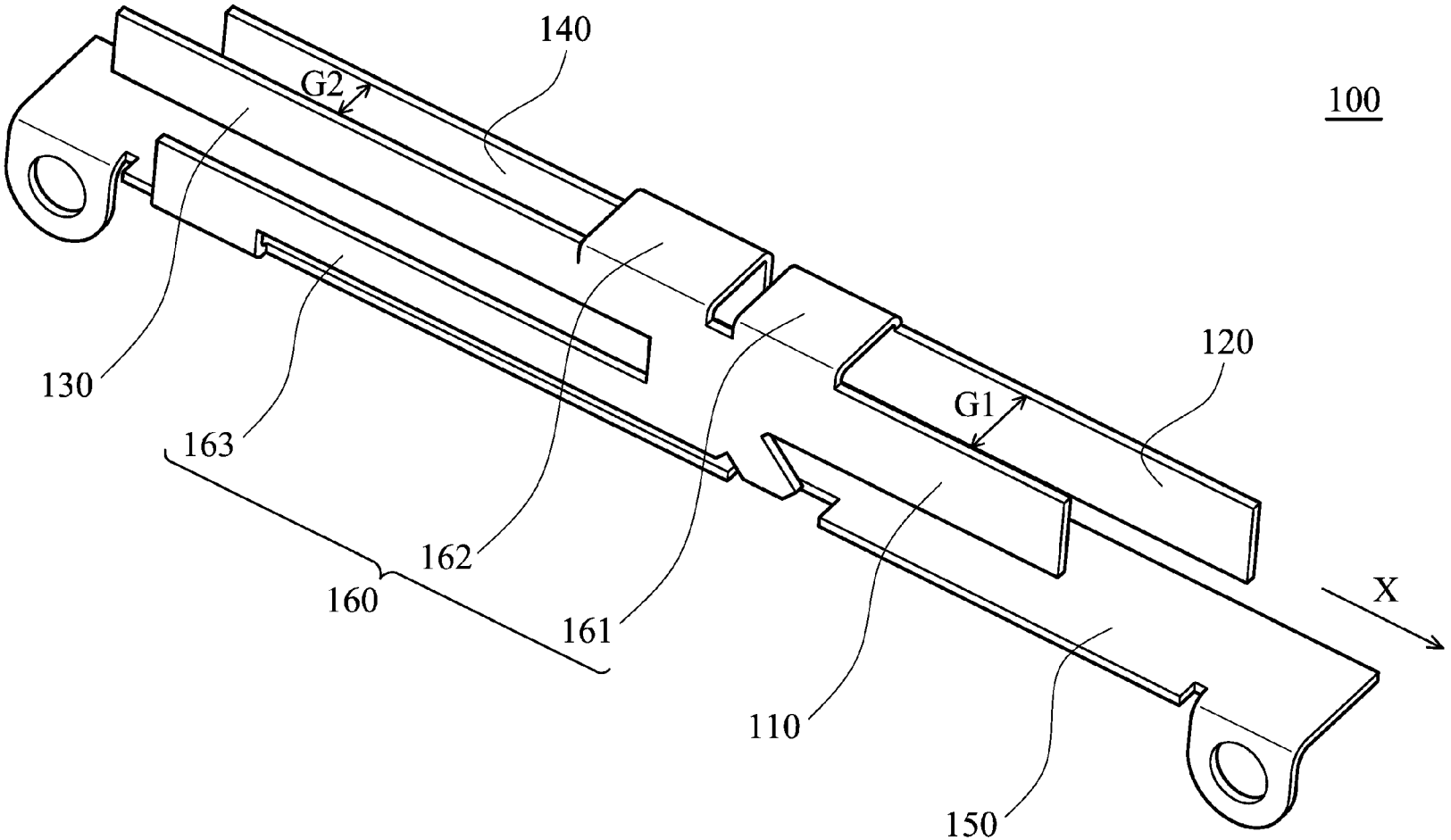
FIG. 1A shows an antenna of an embodiment of the invention.
Figure 1B:
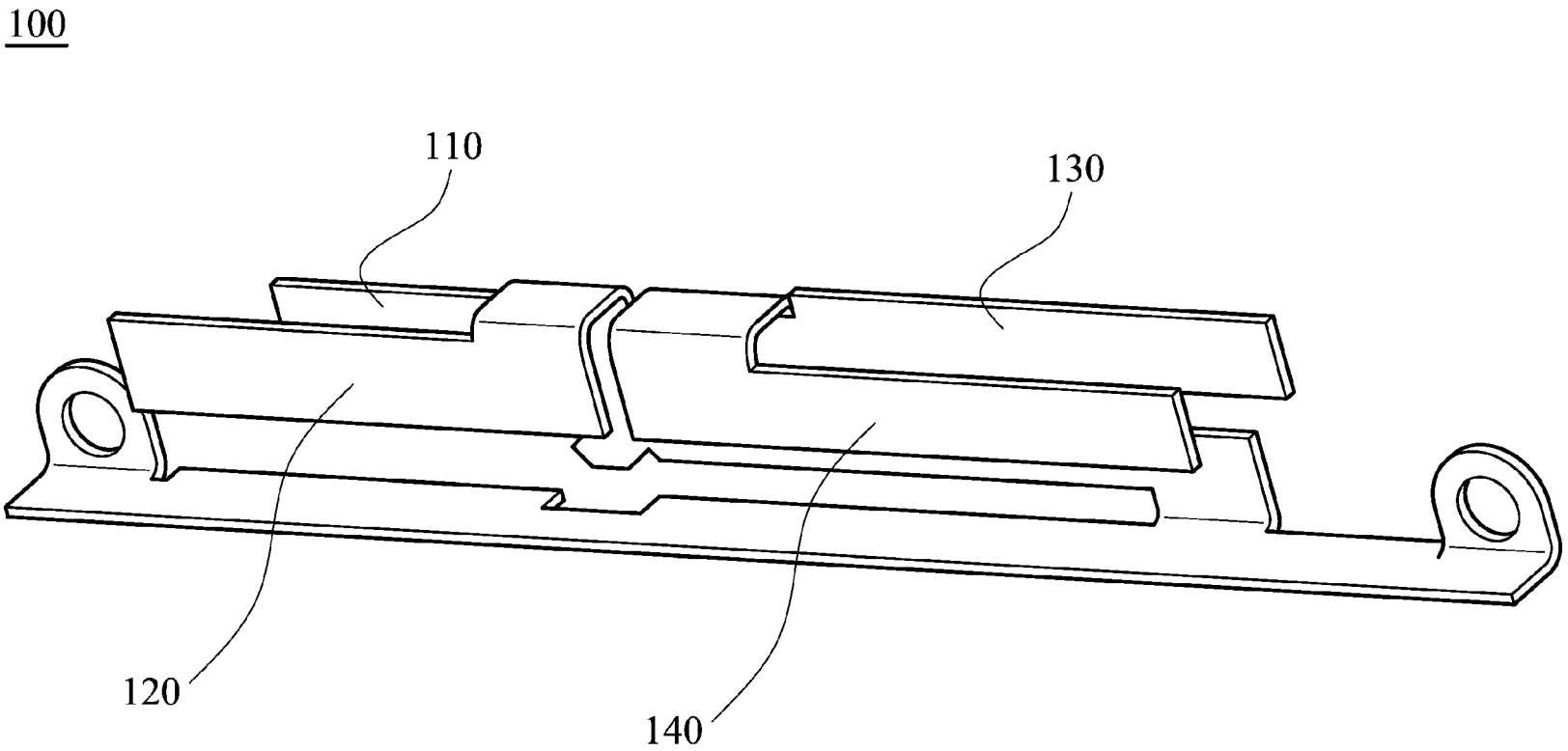
FIG. 1B shows the antenna of the embodiment of the invention in another visual angle.

FIGS. 1A and 1B show an antenna 100 of an embodiment of the invention, which comprises a ground element 150, a connection element 160, a first radiator 110, a second radiator 120, a third radiator 130 and a fourth radiator 140. The connection element 160 is connected to the ground element 150. The first radiator 110 is connected to the connection element 160, and extends toward a first direction (X), wherein the first radiator 110 transmits a first wireless signal. The second radiator 120 is connected to the connection element 160, and extends toward the first direction (X), wherein the second radiator 120 is parallel to the first radiator 110. The second radiator 120 transmits a second wireless signal. The third radiator 130 is connected to the connection element 160, and extends toward a second direction (−X), wherein the third radiator 130 transmits a third wireless signal. The fourth radiator 140 is connected to the connection element 160 and extends toward the second direction (−X), wherein the fourth radiator 140 is parallel to the third radiator 130, and the fourth radiator 140 transmits a fourth wireless signal. The first direction (X) is opposite to the second direction (−X).

The connection element 160 comprises a first across portion 161, a second across portion 162 and an L shaped portion 163. The first across portion 161 straddles between the first radiator 110 and the second radiator 120. The second across portion 162 straddles between the third radiator 130 and the fourth radiator 140. The second radiator 120 is electrically connected to the connection element 160 via the first across portion 161. The fourth radiator 140 is electrically connected to the connection element 160 via the second across portion 162. An end of the L shaped portion 163 is connected to the ground element 150, and the other end of the L shaped portion 163 extends toward the first direction (X).

Figure 2:
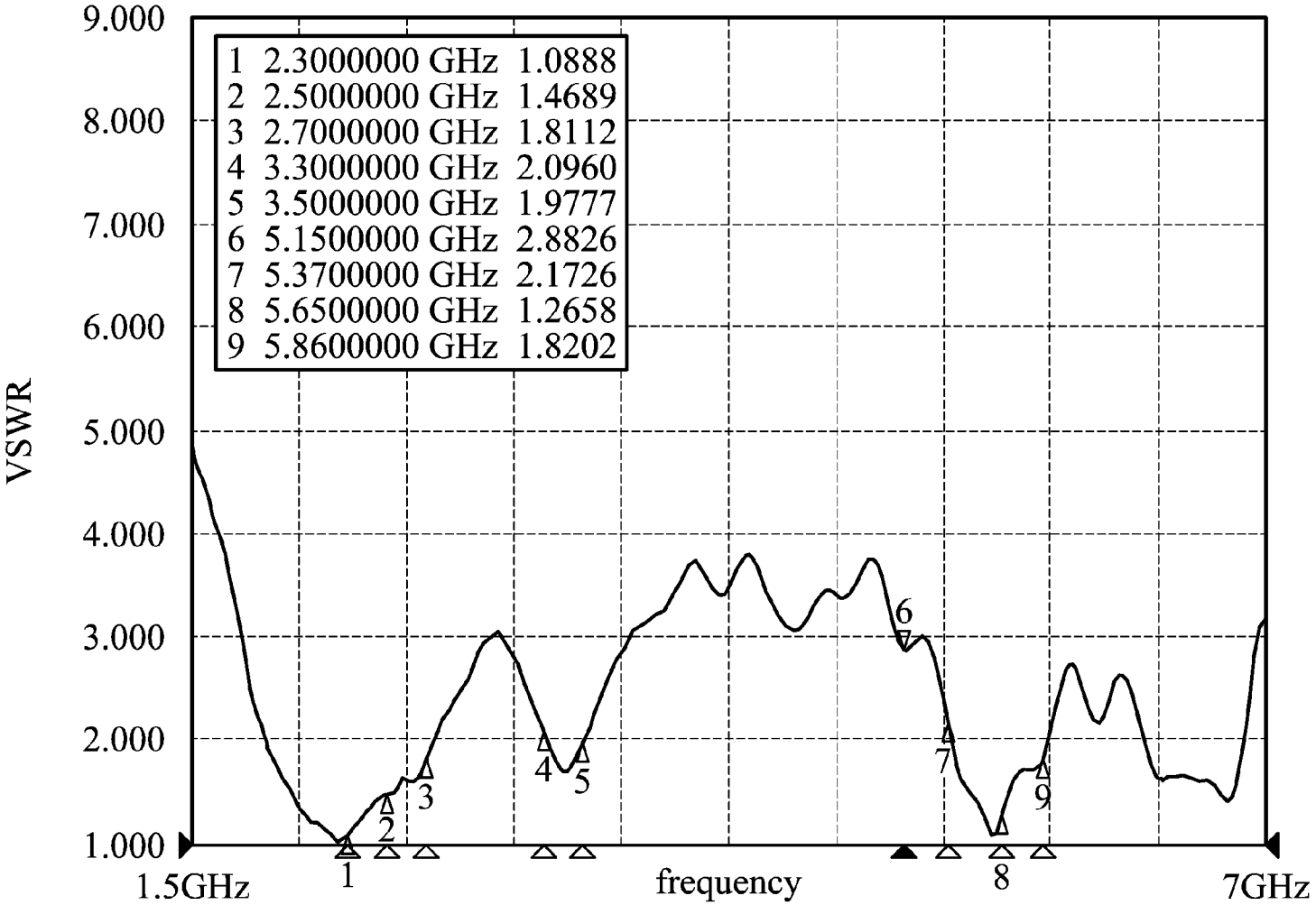
FIG. 2 shows Voltage Standing Wave Ratio (VSWR) of the antenna of the embodiment of the invention.

In this embodiment, the frequency of the first wireless signal is between 5.1 GHz~5.8 GHz, the frequency of the second wireless signal is between 3.3 G Hz~3.5 GHz, the frequency of the third wireless signal is about 2.3 GHz, and the frequency of the fourth wireless signal is about 2.4 GHz. The frequency of the first wireless signal is different from the frequency of the second wireless signal, and the frequency of the third wireless signal is different from the frequency of the fourth wireless signal (two radiators which extend toward the same direction provide two resonance frequency points). When the antenna transmits the first and second wireless signals, the first radiator resonates with the second radiator. When the antenna transmits the third and fourth wireless signals, the third radiator resonates with the fourth radiator. The first radiator resonates with the second radiator to increase bands of the first and second wireless signals, and the third radiator resonates with the fourth radiator to increase bands of the third and fourth wireless, thus, satisfying wideband transmission requirements. FIG. 2 shows Voltage Standing Wave Ratio (VSWR) of the antenna 100 of the embodiment of the invention. As shown in FIG. 2, the antenna 100 has improved bandwidth.

With reference to FIG. 1A, a first gap G1 is formed between the first radiator 110 and the second radiator 120, and the first gap G1 is about 1/32 of a wavelength of the first wireless signal (a relatively higher band when compared to the second wireless signal). A second gap G2 is formed between the third radiator 130 and the fourth radiator 140, and the second gap G2 is 1/32 of a wavelength of the fourth wireless signal (a relatively higher band when compared to the third wireless signal).

The frequencies of the first, second, third and fourth wireless signals (resonance frequency points) can be modified. For example, the frequency of the third wireless signal can be 2.4 GHz (resonance frequency point), and the frequency of the fourth wireless signal can be 2.5 GHz (resonance frequency point). The frequencies of the third and fourth wireless signals can be selected to be between around 2.3 GHz~2.8 GHz. However, the frequency of the third wireless signal differs from the frequency of the fourth wireless signal.

In this embodiment of the invention, the first radiator 110 and the third radiator 130 are located on a same plane. The first radiator 110 and the second radiator 120 are located on different planes. The third radiator 130 and the fourth radiator 140 are located on different planes.

In this embodiment of the invention, the length of the first radiator 110 is about 8~11 mm, the length of the second radiator 120 is about 11~14 mm, the length of the third radiator 130 is about 15~18 mm, and the length of the fourth radiator 140 is about 14~17 mm. The dimensions disclosed above do not limit the invention.

In this embodiment of the invention, the transmission band of each radiator is increased by the resonance effect between radiator pairs (for example, first and second radiators). In one embodiment, resonance between the radiators can provide a specific transmission band. For example, resonance between the radiators which are designed for transmitting wireless signals of 4.85 GHz~5.85 GHz can provide a transmission band between 3.3 GHz~3.5 GHz.

Figure 3:
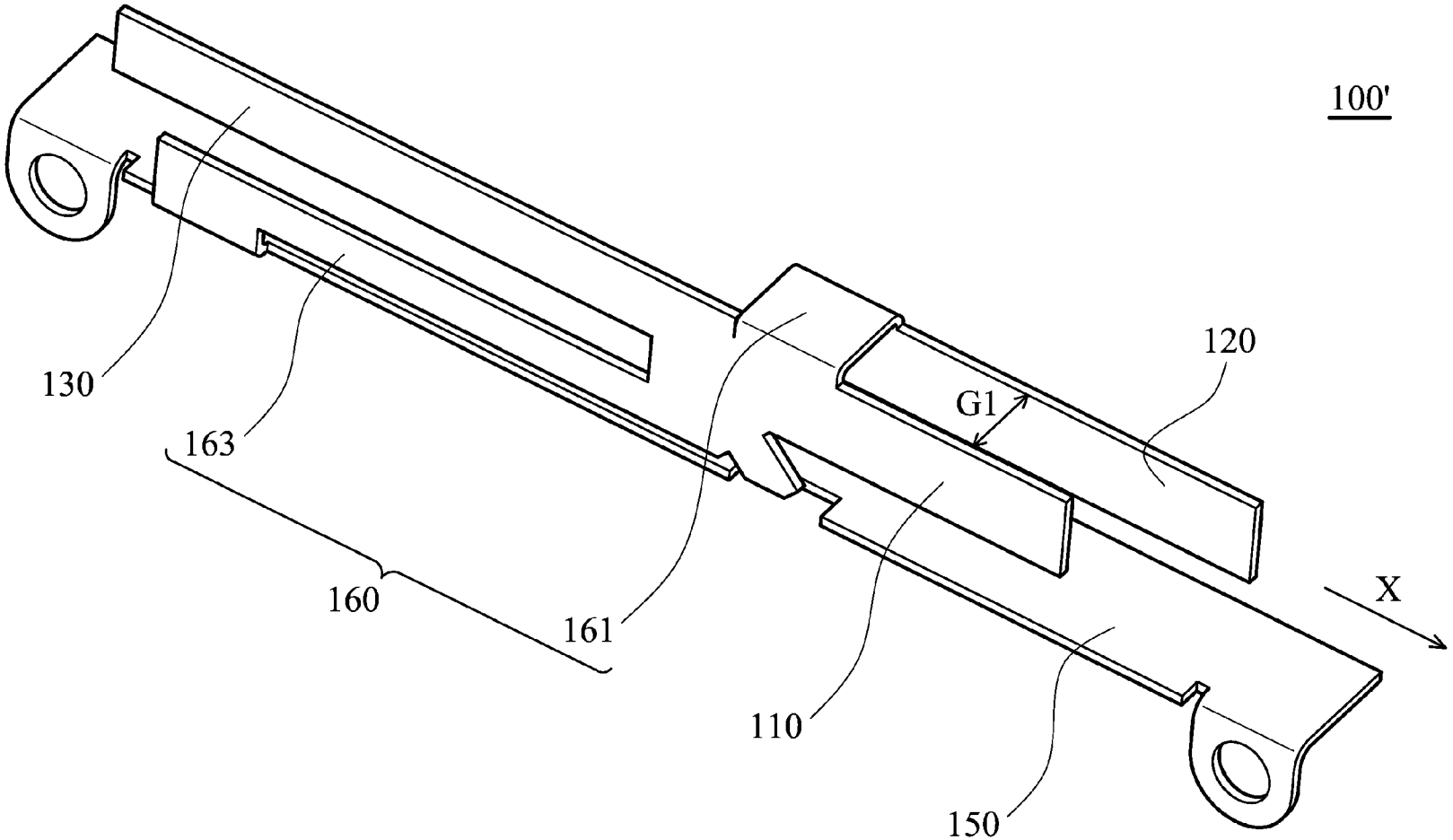
FIG. 3 shows an antenna of a modified example of the invention.

The resonance structure of the embodiment of the invention can be utilized with other antenna structures. FIG. 3 shows an antenna 100' of a modified example of the invention, wherein the fourth radiator is omitted, and wireless signals of 2.4 GHz~2.5 GHz are simply transmitted via the third radiator 130. In FIG. 3, the resonance structure of the invention (the first radiator 110 and the second radiator 120) is utilized with an antenna structure without a resonance design (third radiator 130).

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, comprising:

a ground element;

a connection element, connecting to the ground element;

a first radiator, connecting to the connection element and extending toward a first direction, wherein the first radiator transmits a first wireless signal;

a second radiator, connecting to the connection element and extending toward the first direction, wherein the second radiator transmits a second wireless signal, a frequency of the first wireless signal is different from a frequency of the second wireless signal, and when the antenna transmits the first and second wireless signals, the first radiator resonates with the second radiator;

a third radiator, connecting to the connection element and extending toward a second direction, wherein the third radiator transmits a third wireless signal; and a fourth radiator, connecting to the connection element and extending toward the second direction, wherein the fourth radiator is parallel to the third radiator, the fourth radiator transmits a fourth wireless signal, a frequency of the third wireless signal is different from a frequency of the fourth wireless signal, and the first direction is opposite to the second direction, and when the antenna transmits the third and fourth wireless signals, the third radiator resonates with the fourth radiator, wherein the first radiator is located on a first plane, the second radiator is located on a second plane, and the first plane is spaced apart from and parallel to the second plane, wherein the frequency of the first wireless signal is between 5.1GHz~5.8GHz, and the frequency of the second wireless signal is between 3.3GHz~3.5GHz, wherein a first gap is formed between the first radiator and the second radiator, and the first gap is 1/32 of a wavelength of the first wireless signal.

2. The antenna as claimed in claim 1, wherein the connection element comprises an L shaped portion, an end of the L shaped portion is connected to the ground element, and the other end of the L shaped portion extends toward the first direction.

3. The antenna as claimed in claim 1, wherein the connection element comprises a first across portion and a second across portion, the first across portion straddles between the first radiator and the second radiator, the second across portion straddles between the third radiator and the fourth radiator, the second radiator is electrically connected to the connection element via the first across portion, and the fourth radiator is electrically connected to the connection element via the second across portion.

4. The antenna as claimed in claim 1, wherein the frequency of the third wireless signal is 2.3GHz, and the frequency of the fourth wireless signal is 2.4GHz.

5. The antenna as claimed in claim 4, wherein a second gap is formed between the third radiator and the fourth radiator, and the second gap is 1/32 of a wavelength of the fourth wireless signal.

6. The antenna as claimed in claim 4, wherein the first radiator and the third radiator are located on a same plane.

7. The antenna as claimed in claim 1, wherein the third radiator is located on the first plane, the fourth radiator is located on a third plane, and the first plane is spaced apart from and parallel to the third plane.

8. An antenna, comprising:

a ground element;

a connection element, connecting to the ground element;

a first radiator, connecting to the connection element and extending toward a first direction, wherein the first radiator transmits a first wireless signal; and a second radiator, connecting to the connection element and extending toward the first direction, wherein the second radiator transmits a second wireless signal, a frequency of the first wireless signal is different from a frequency of the second wireless signal, and when the antenna transmits the first and second wireless signals, the first radiator resonates with the second radiator, wherein the first radiator is located on a first plane, the second radiator is located on a second plane, and the first plane is spaced apart from and parallel to the second plane, wherein the frequency of the first wireless signal is between 5.1GHz~5.8GHz, and the frequency of the second wireless signal is between 3.3GHz~3.5GHz, wherein a first gap is formed between the first radiator and the second radiator, and the first gap is 1/32 of a wavelength of the first wireless signal.

9. The antenna as claimed in claim 8, further comprising a third radiator, connecting to the connection element and extending toward a second direction, wherein the third radiator transmits a third wireless signal, and the first direction is opposite to the second direction.

10. The antenna as claimed in claim 9, wherein the frequency of the third wireless signal is between 2.4GHz~2.5GHz.

11. The antenna as claimed in claim 8, wherein the connection element comprises an L shaped portion, an end of the L shaped portion is connected to the ground element, and the other end of the L shaped portion extends toward the first direction.

12. The antenna as claimed in claim 8, wherein the connection element comprises a first across portion, the first across portion straddles between the first radiator and the second radiator, and the second radiator is electrically connected to the connection element via the first across portion.

* * * * *